US012551743B2

(12) United States Patent
Gwizdalski

(10) Patent No.: US 12,551,743 B2
(45) Date of Patent: Feb. 17, 2026

(54) EXERCISE DEVICE AND METHODS FOR USE

(71) Applicant: DJG Marketing LLC, Long Beach, CA (US)

(72) Inventor: Don J. Gwizdalski, Long Beach, CA (US)

(73) Assignee: DJG Marketing LLC, Long Beach, CA (US)

( * ) Notice: Subject to any disclaimer, the term of this patent is extended or adjusted under 35 U.S.C. 154(b) by 69 days.

(21) Appl. No.: 18/209,885

(22) Filed: Jun. 14, 2023

(65) Prior Publication Data

US 2024/0342532 A1 Oct. 17, 2024

Related U.S. Application Data

(63) Continuation-in-part of application No. 29/889,586, filed on Apr. 13, 2023, and a continuation-in-part of application No. 29/889,588, filed on Apr. 13, 2023.

(51) Int. Cl.
*A63B 21/00* (2006.01)
*A63B 23/02* (2006.01)

(52) U.S. Cl.
CPC ..... *A63B 21/0004* (2013.01); *A63B 21/4035* (2015.10); *A63B 23/0205* (2013.01); *A63B 2208/0252* (2013.01); *A63B 2210/50* (2013.01)

(58) Field of Classification Search
CPC ..... A63B 21/0004; A63B 21/4035; A63B 23/0205; A63B 23/0211; A63B 2208/0252; A63B 2210/50
See application file for complete search history.

(56) References Cited

U.S. PATENT DOCUMENTS 3,049,130 A * 8/1962 Fuschetti ..... A45D 44/10 5/652
D226,151 S 1/1973 Pawsat et al.
(Continued)

FOREIGN PATENT DOCUMENTS

BR 3020210045354 9/2021
CN 301848573 2/2012
(Continued)

OTHER PUBLICATIONS

Massotherapy Self Massage Tools Roller, amazon.com, first available Aug. 6, 2018 [online], [site visited Jul. 24, 2025], Available from internet URL: https://www.amazon.com/Massage-Tools-Roller-Shoulders-Necky/dp/B07G7HFZZ8.

*Primary Examiner* — Joshua Lee
(74) *Attorney, Agent, or Firm* — Fulwider Patton LLP

(57) ABSTRACT

An exercise device for performing sit-ups and other exercises in a supine or seated position includes a middle portion contoured to fit around the back of the user's neck, and end portions serving as hand grips to hold the user's hands at shoulder width slightly forward and above the user's shoulders when in use. The device is construed of three detachable tubular segments of similar shape and substantially equal length telescopically joined together and locked in place by retractable locking pins. The hand grips can be selectively connected to the middle portion in two different operative positions, one generally parallel to the longitudinal axis of the device and one generally perpendicular to the longitudinal axis of the device. The device can be disassembled for compact storage and is less than 30 inches long and about 5 inches to 6 inches wide.

20 Claims, 8 Drawing Sheets

(56) References Cited

U.S. PATENT DOCUMENTS

| | | | | |
|---|---|---|---|---|
| 3,820,781 | A | 6/1974 | Kane | |
| 3,834,410 | A | 9/1974 | Leibel | |
| 4,335,875 | A | 6/1982 | Elkin | |
| 4,429,870 | A | 2/1984 | Gibbs | |
| D281,446 | S | 11/1985 | Keilman | |
| 4,691,917 | A | 9/1987 | Battista | |
| 4,770,414 | A | 9/1988 | Fredrickson et al. | |
| 4,789,154 | A | 12/1988 | Mattox | |
| 4,852,873 | A * | 8/1989 | O'Donnell | A63B 21/00043 482/122 |
| 4,863,158 | A * | 9/1989 | Tassone | A63B 21/4017 482/106 |
| D305,446 | S | 1/1990 | Valentine | |
| D330,738 | S | 11/1992 | Lenhardt | |
| 5,221,244 | A | 6/1993 | Doss | |
| 5,269,737 | A * | 12/1993 | Sobotka | A63B 21/0552 482/130 |
| 5,312,314 | A | 5/1994 | Stephan et al. | |
| 5,492,520 | A | 2/1996 | Brown | |
| 5,498,218 | A | 3/1996 | Proctor | |
| D369,627 | S | 5/1996 | Thor | |
| 5,514,058 | A | 5/1996 | Buoni | |
| 5,580,342 | A | 12/1996 | Johnson | |
| 5,591,111 | A | 1/1997 | Wang et al. | |
| D385,601 | S * | 10/1997 | Uen | D21/691 |
| 5,752,903 | A | 5/1998 | Chang | |
| 5,868,651 | A * | 2/1999 | Washington | A63B 21/00043 482/122 |
| 5,897,471 | A * | 4/1999 | Multanen | A63B 21/00043 422/126 |
| 5,935,049 | A * | 8/1999 | Hamm | A63B 23/0211 482/131 |
| D413,948 | S * | 9/1999 | Dalebout | D21/687 |
| 6,022,303 | A | 2/2000 | Abdo | |
| 6,048,294 | A | 4/2000 | Formanek | |
| 6,196,949 | B1 | 3/2001 | Rodarte | |
| 6,248,047 | B1 * | 6/2001 | Abdo | A63B 21/023 482/121 |
| D447,779 | S | 9/2001 | Munger | |
| 6,432,029 | B1 * | 8/2002 | Almeda | A63B 21/00047 482/142 |
| 7,578,775 | B2 * | 8/2009 | Terry | A63B 23/03508 482/121 |
| 7,867,102 | B2 * | 1/2011 | Wallace | A63B 21/0552 473/220 |
| 7,993,252 | B2 | 8/2011 | Barrie et al. | |
| D657,009 | S | 4/2012 | Krull | |
| D662,161 | S * | 6/2012 | Miller | D21/679 |
| D706,428 | S | 6/2014 | Manzo | |
| 9,005,087 | B1 * | 4/2015 | Betoney, Jr. | A63B 21/072 482/93 |
| D777,625 | S | 1/2017 | Chang | |
| 10,149,998 | B2 * | 12/2018 | Wu | A63B 23/0405 |
| D843,506 | S | 3/2019 | Campanaro | |
| D874,585 | S | 2/2020 | Pellegrino | |
| D910,126 | S | 2/2021 | Dimarco | |
| D934,366 | S | 10/2021 | Rasmussen | |
| D979,724 | S | 2/2023 | Zhao | |
| 11,571,604 | B2 * | 2/2023 | Aref | A63B 23/0216 |
| D1,055,180 | S | 12/2024 | Walker | |
| 2004/0002413 | A1 | 1/2004 | Wimber | |
| 2004/0082449 | A1 | 4/2004 | Brown, Jr. | |
| 2007/0225134 | A1 | 9/2007 | Slattery | |
| 2010/0018341 | A1 | 1/2010 | Greppi | |
| 2010/0186543 | A1 | 7/2010 | Menghini | |
| 2010/0255967 | A1 | 10/2010 | Richardson | |
| 2011/0152044 | A1 | 6/2011 | Klein | |
| 2011/0201483 | A1 | 8/2011 | Holleman | |
| 2018/0093124 | A1 | 4/2018 | Roybal | |
| 2022/0233911 | A1 | 7/2022 | Johnson, III | |
| 2023/0310259 | A1 | 10/2023 | Markowski | |

FOREIGN PATENT DOCUMENTS

| | | |
|---|---|---|
| CN | 304888363 | 11/2018 |
| CN | 304888364 | 11/2018 |
| CN | 306872772 | 10/2021 |
| CN | 307820895 | 1/2023 |
| CN | 307699527 | 3/2023 |
| RU | 00100112 | 10/2016 |

* cited by examiner

EXERCISE DEVICE AND METHODS FOR USE

CROSS REFERENCE TO RELATED APPLICATIONS

This application is a continuation-in-part of prior application Ser. No. 29/889,586, filed Apr. 13, 2023, and prior application Ser. No. 29/889,588, filed Apr. 13, 2023, the contents of which are incorporated herein by reference in their entirety.

BACKGROUND OF THE INVENTION

I. Field of the Invention

This invention relates generally to exercise devices, and more particularly, has reference to a new exercise device enabling a user to perform exercises for firming and toning the abdominal muscles while in a supine or seated position with reduced stress and strain on the user's shoulders, neck and back.

II. State of the Art

Sit-ups are a popular exercise for strengthening and toning the abdominal muscles and as such is the most commonly used abdominal exercise. Sit-ups are typically performed by a person lying upon their back with knees bent and feet flat on the floor. The person then contracts the abdominal muscles to raise the head and upper body off the ground. The person's hands are clasped behind the head with the elbows forward so that the elbows touch the knees when the head and shoulders are lifted.

Conventional sit-ups can strain a persons neck and shoulder muscles due to the stress and pulling forces required in order for the person to continually clasp their hands behind their head. Sit-ups can be made easier by crossing the arms in front of the body and placing the palms on the front of the shoulders. However, such a variation can make the exercise less intense and effective.

Conventional sit-ups also may cause back pain and arching of the lower back, increasing the risk of back injury. For these reasons, some organizations have begun to phase out sit-ups due the high rate of lower back injury.

As an alternative to sit-up type exercises, there are twisting abdominal exercises which are performed by a person while in a standing or upright position. In a torso-twisting exercise, a user typically places a shaft-like device or exercise bar along the back of the neck and resting on the shoulders, with the arms draped over the top of the bar or the hands gripping the ends of the bar extended out at full arm spread. The user then goes through a series of exercise movements, the result of which is to exert tension on the abdominal muscles. In one of these movements, the body is twisted, or rotated, from side to side. In another, the body is bent at the waist while the user attempts to touch one end of the shaft or bar to the opposite foot.

However, such bars have drawbacks. A bar behind the neck puts most of the muscle groups in the upper body out of their natural position. As a result, those muscles can become sore, causing user discomfort which is a disincentive to continue the exercise. It is also very uncomfortable, causing unnecessary strain because the shoulders must be retracted far backwards to accommodate the straight line of the shaft.

The wide hand position involving a full arm spread also puts additional stress on the auxiliary and secondary muscles groups in the shoulders, back and neck. The pectorals (chest muscles), upper trapezius (upper back muscles) and neck muscles all can be stressed, especially if the user's shoulders are tight. The sheer length of the bar, often extending five to six feet, also makes it awkward to use, difficult to transport and store, and unsuitable for use in performing exercises when in a supine or seated position.

Exercises performed in a standing or upright position also do less to isolate the abdominal muscles because more muscle groups are being used than with exercises performed in a supine or seated position. A supine or seated position also is safer for the back and neck when strengthening or stretching muscles because of its friendlier relationship to gravity, particularly when doing exercises that combine force and torque, like many of the traditional abdominal exercises.

A need exists for an exercise device that can be used for performing abdominal exercises while in a supine or seated position, which reduces the stress and strain on the user's shoulders, neck and back when performing the exercises, which is compact and easy to store and transport, which is inexpensive to manufacture, and which can be used to perform a variety of different exercises. The present invention fulfills all of these needs.

SUMMARY OF THE INVENTION

Briefly, and in general terms, the present invention provides a new and improved exercise device for use in performing sit-ups and other abdominal exercise in a supine or seated position, that reduces the stress and strain on a user's neck, shoulders and lower back by keeping the user's hands, head and neck in the proper position for safely and effectively isolating and targeting the abdominal muscles for exercise. The device is small and compact, relatively inexpensive to manufacture, easy to use, and can be quickly and conveniently disassembled for easy storage and travel.

More specifically, and in a presently preferred embodiment, by way of example and not necessarily by way of limitation, the present invention is embodied a small hand-held device that can be placed behind a user's neck when performing abdominal exercises in a supine or seated position. It comprises a substantially rigid assembly of predetermined length which includes at its ends a pair of left and right hand grip portions that are held in a laterally spaced position at a distance corresponding to a user's shoulder width by a transversely extending middle portion which is continuous and coplanar with the hand grip portions and is contoured along a plane to fit comfortably around the back of the user's neck and to hold the hand grips slightly forward of and above the user's shoulders when the device is in use. Each of the hand grip portions has a substantially linear central portion bounded by two angled end portions which confine the user's hands to the central portion of the hand grip, the central portions being spaced apart by a distance corresponding to the user's shoulder width so that the user's hands are spaced at shoulder width when grasping the central portions.

In a preferred embodiment, the hand grips are arranged to be generally parallel to the user's shoulders with the palms of the user's hands facing forward when in use. In an alternative embodiment, the hands grips are arranged to be generally perpendicular to user's shoulders with the palms of the user's hands facing inward toward each other when in use. In a presently preferred embodiment of the invention, the hand grips are reconfigurable and reversable allowing the user to choose which of those two hand grip orientations he wishes to use.

In a preferred embodiment, the exercise device is made of lightweight rigid tubular material, such as aluminum or PVC.

In a preferred embodiment, padding is provided around at least the mid-section of the middle tubular portion to protect the surface of the device and to cushion the device against the user's neck, thus enhancing user comfort and reducing skin abrasion when the exercise device is in use.

In a presently preferred embodiment, the hand grip portions are detachably connected to the middle portion. Preferably, the device is constructed out of three telescoping sequential tubular segments of substantially equal length corresponding to the left and right hand grip portions and the middle portion, respectively, each of which are selectively connected to each other by retractable locking pins which lock the telescoping tubular members in place relative to one another.

Preferably, the exercise device has a length of about 26", and a width of about 5" to about 6" when fully assembled. When disassembled, the device can be conveniently and compactly stored in a small storage pouch.

The present invention also is directed to various methods for using the aforementioned exercise device to exercise the abdominal muscles while in a supine or seated position. In one presently preferred method, a user performs sit-up type exercises by grasping the hand grip portions of the exercise device with both hands such that the person's hands are positioned at shoulder width in a laterally spaced position slightly forward and above the user's shoulders, while holding the middle portion of the exercise device against the back of the user's neck above the user's shoulders. From a supine position, the user then contracts the abdominal muscles to elevate the user's back from the floor toward the knees while gripping the exercise device and holding it against the back of the user's neck above the user's shoulders, relaxes the abdominal muscles to lower the user's back to the floor while griping the exercise device and holding it against the back of the user's neck above the user's shoulders, and repeats said contracting and relaxing steps multiple times as desired to exercise the abdominal muscles.

In other preferred method for exercising abdominal muscles, the user places the aforementioned hand-held device behind the user's neck while in a supine or seated position, grasps the hand grip portions of the device with both hands such that the user's hands are positioned at shoulder width in a laterally spaced position slightly forward and above the user's shoulders, while holding the middle portion of the device against the back of the user's neck above the shoulders, and performs an exercise selected from the group consisting of sit-ups, bicycle crunches, elevated leg crunches, Russian twists, the static boat pose, leg raises and reverse crunches, all while grasping the hand grip portions and holding the middle portion against the back of the user's neck above the user's shoulders.

In yet another preferred method, the user performs rowing type exercise with the aid of an elastic resistance band while in a seated position with legs outstretched, by connecting the ends of a resistance band to the exercise device, placing a central portion of the resistance band over the bottoms of the user's feet, grasping the hand grips with both hands with palms facing downward, pulling the exercise device toward the user's chest against the contracting force of the resistance band, relaxing to allow the resistance band to return the exercise device to a position closer to the user's feet, and repeating the pulling and relaxing steps multiple times as desired to simulate a rowing action.

These and other features and advantages of the invention will become apparent from the following more detailed description, taken in conjunction with the accompanying drawings, which illustrate, by way of example, features of the present invention.

DETAILED DESCRIPTION OF THE PREFERRED EMBODIMENTS

Figure 1:
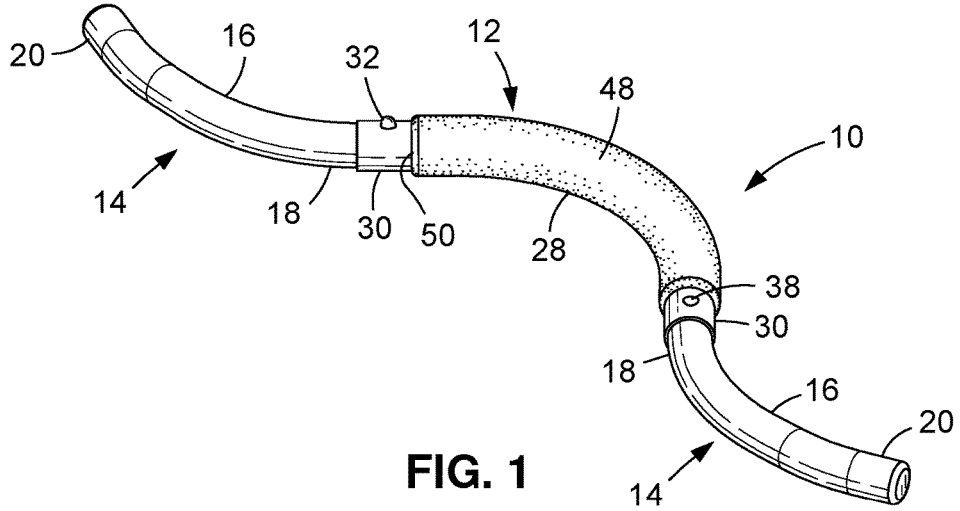
FIG. 1 is a perspective view of a exercise device, as seen from above, constructed in accordance with the present invention.
Figure 2:
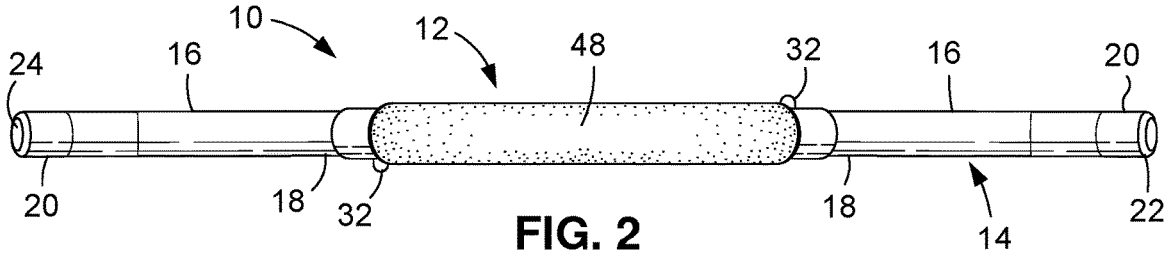
FIG. 2 is a rear view of the exercise device shown in FIG. 1.
Figure 3:
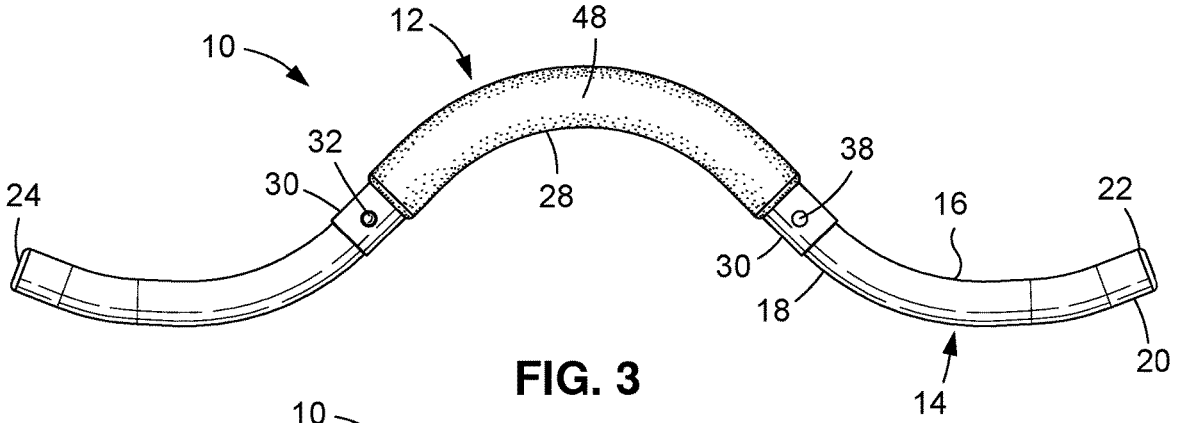
FIG. 3 is a top plan view of the exercise device shown in FIG. 1.
Figure 4:
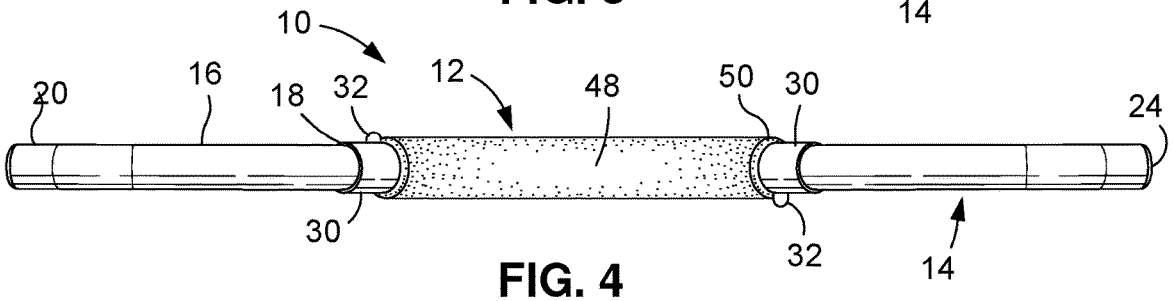
FIG. 4 is a front view of the exercise device shown in FIG. 1.

As shown in the drawings for purposes of illustration, the invention is embodied in a hand-held exercise device 10 designed for use in performing abdominal exercises from a supine or seated position while on a floor, exercise mat or other surface. The device 10 includes a contoured middle portion 12 for fitting comfortably around the back of the user's neck and a pair of end portions 14 which are designed to be gripped by the user's hands when in use.

In accordance with the present invention, the end portions 14 of the device extend away from the middle portion 12 in opposite directions, preferably along the same plane as the middle portion, and serve as positive hand grips to maintain the user's hands at shoulder width during use. Each end portion 14 is preferably about the same length as the middle portion 12. The hand grips 14 are designed to be gripped by the user's hands during use, and they are distanced sufficiently apart that the users hands will be maintained at shoulder width when gripping them. Further, in a preferred embodiment, the end portions 14 are selectively detachable from the middle portion 12 and can be connected to the middle portion in two different ways, which allows the user to choose between two different hand positions, both at shoulder width, when the device is in use, and to selectively reduce the size of the device for compact storage and transport.

In a preferred embodiment, as best shown in FIGS. 1-4, each hand grip 14 includes a central portion 16 flanked by two end portions, i.e., an inward end portion 18 joined to the middle portion 12, and an outward end portion 20. In a preferred embodiment, the central portion 16 of each hand grip is relatively straight and generally parallel to the longitudinal axis of the exercise device 10, such that the palms of the user's hand will face forward when the central portion is gripped by the user's hands during use. In a preferred embodiment, the central portions 16 are also aligned with each other along a longitudinal axis that is generally parallel to the user's shoulders when in use. Preferably, each central portion 16 has a width of about 4" to accommodate the width of a typical user's hand and which is more comfortable on the user's wrist when the user is gripping the device.

The end portions 18, 20 of the hand grips 14 extend rearwardly at an angle from the central portion 16, and serve as the outer boundary or limit confining the user's hands to the central portion of the hand grip. A low bend angle of about 20° relative to the longitudinal axis of the central portion 16 is preferred for the outward end portion 20, while a slightly greater bend angle of about 45° is preferred for the inward end portion 18, although variations in the bend angles are permissible. Each end portion 18, 20 is preferably straight with a length of about 1" to about 2".

Figure 8:
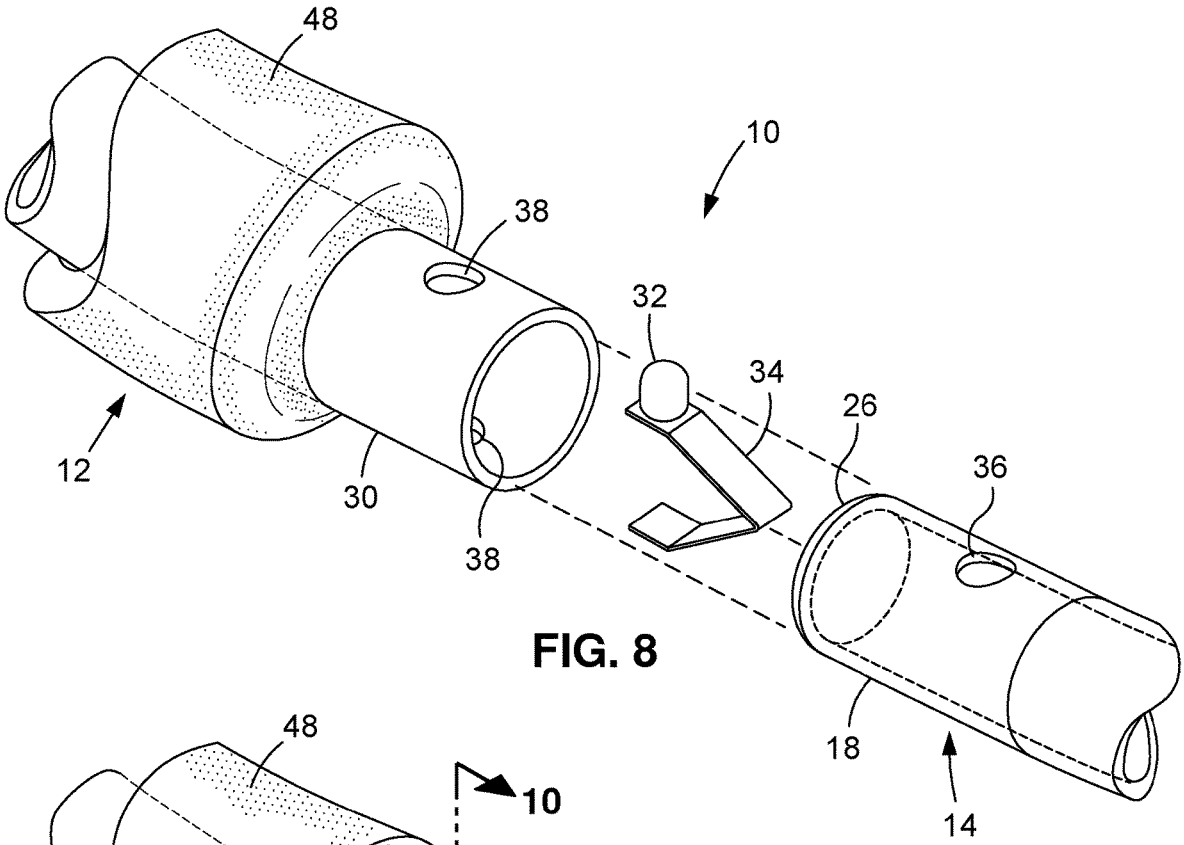
FIG. 8 is an enlarged fragmentary view showing in exploded fashion the components of the device for detachably connecting the middle and end portions in a telescoping arrangement.

It is preferred that the outward ends 22 of the outward end portions 20 be blunt or flat, and fitted with plastic push-in end caps 24 having rounded or beveled edges for greater safety. The inwardmost ends 26 of the inward end portions 18 also can be fitted with plastic end caps, if desired. The inwardmost ends are best shown in FIG. 8.

Figure 5:
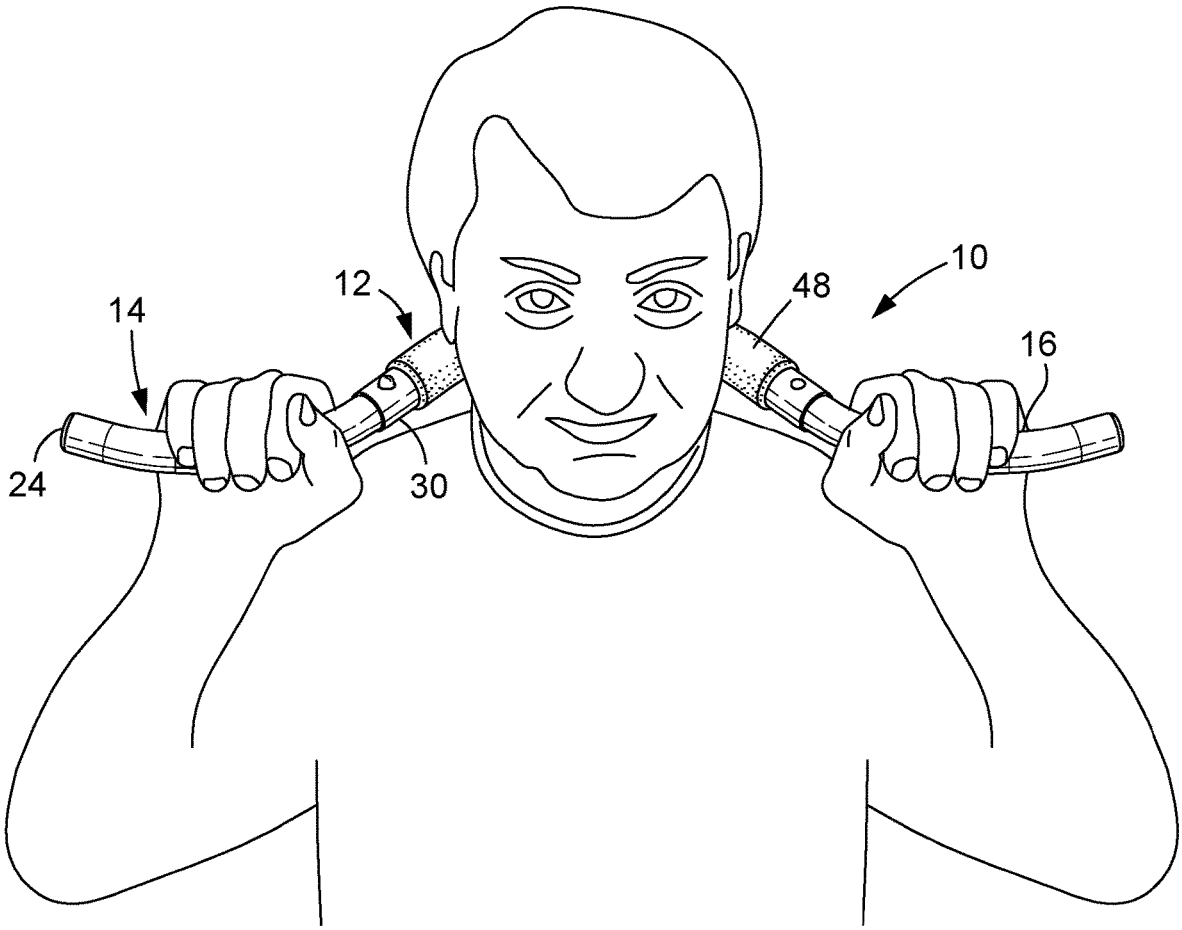
FIG. 5 is a front perspective view of a user utilizing the device shown in FIG. 1.

The middle portion 12 of the exercise device 10 has a curved center section 28 terminating in two straight end sections 30. The center section 28 preferably has a centerline radius of about 5" extending through an arc of about 90° to fit comfortably around the back of the user's neck. The center of curvature is also preferably fixed at or about midway between the hand grips 14, so that it will be located directly behind the user's neck when the device 10 is properly placed for exercising. The straight end sections 30 preferably have a length of about 2" to about 3". The depth of the middle portion is selected to accommodate the distance between the back of the user's neck and a position slightly forward of the user's shoulders where the hand grips will lie when the device 10 is in use, as best shown in FIG. 5. By fitting behind the user's neck while extending slightly forward of and above the user's shoulders, the device 10 does not require the user's hands and shoulders to be flexed backward when in use, thus relieving the stress and pulling force on the shoulders and neck muscles which can occur when performing conventional sit-ups with the hands clasped behind the user's head. By fixing the user's hand at shoulder width when in use, the device avoids stressing the auxiliary and secondary muscles groups in the user's shoulders, back and neck which can occur if the user's arms were spread.

The present invention allows construction of a device 10 to fit any size person. In a preferred embodiment, the distance between the front of each hand grip portion 14 and the back of the middle portion 12 is about 5" to about 6", and more preferably about 5.5", and the distance between the hand grips 14 is about 13" to about 15", and more preferably about 14", as measured between the center of each hand grip. The overall length of the device 10 is preferably no more than about 3', and more preferably no more than about 30", as measured along a straight line joining the outermost ends 22 of the device. In a preferred embodiment, the overall length is about 25" to about 27", and most preferably about 26", as measured along a straight line joining the outermost ends 22 of the device 10. This is sufficient to accommodate most shoulder widths, yet small enough to be easily compacted for storage and transport as described in more detail below. Smaller physiques of women and children may benefit from a slightly different set of measurements for the device.

The device 10 is preferably constructed of lightweight rigid tubular material, such as metal (for example, aluminum) or plastic (for example, PVC) which results in a light weight, easy to use device which is also easy and inexpensive to manufacture. The tubular construction can best be seen in FIGS. 8-10. When using metal such as lightweight tubular aluminum, the outer surface of the metal can be given a smooth finish or it can be given a textured finish to create extra grip for the user's hands, if desired.

The device 10 is preferably made from hollow tube stock which is circular in cross section, although other shapes can be used if desired. The outside diameter of the tube stock is a parameter that can affect user comfort. The larger the outside diameter, the larger the area over which force is distributed. Hence, a large diameter can prevent soreness due to pressure of the device against the body. The maximum outside diameter is limited by the comfort of the user's hands gripping the device. The outside diameter of the tube stock can be useful when as large as 3", although an outside diameter of about 2" is generally the maximum to which most users would become easily accustomed. An outside diameter in the range of about 1" to about 1¼" is preferred.

In a preferred embodiment, the device 10 is constructed out of three telescoping tubing segments that snap together and can be easily connected or disconnected for reconfiguration and for compact storing and transport.

Figure 6:
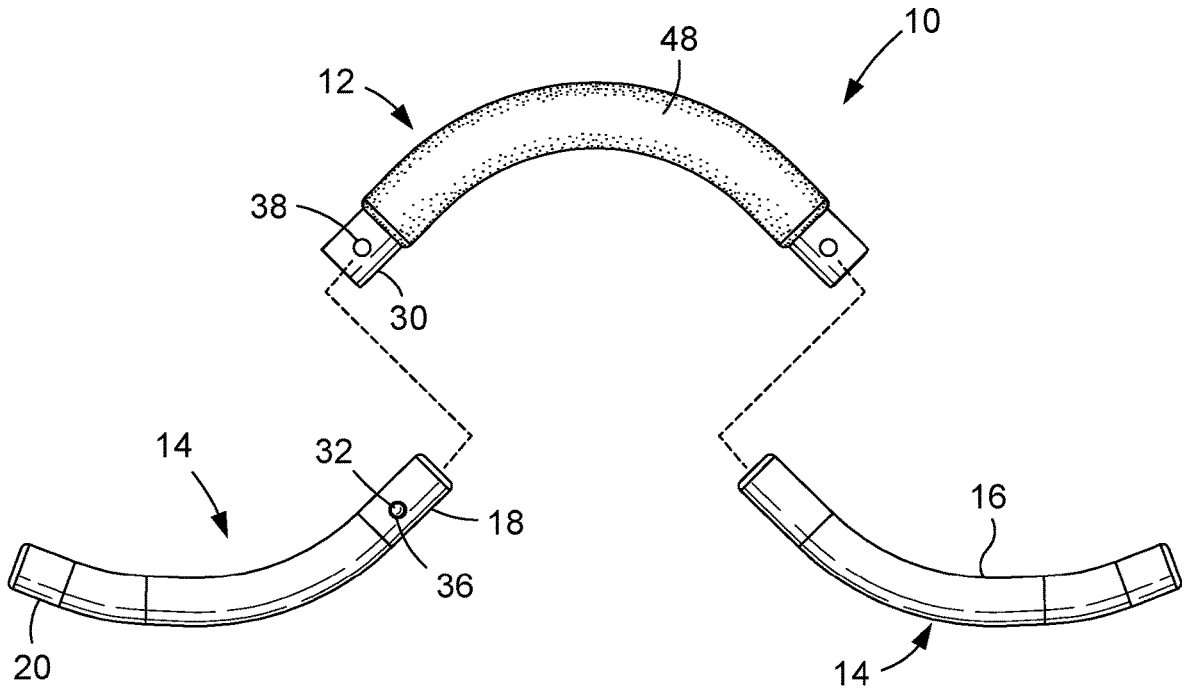
FIG. 6 is a top plan view of the device in FIG. 3, shown as three detached segments in a knock-down mode.

FIG. 6 shows a preferred telescoping construction for the device 10 configured such that the left and right side hand grips 14 are detachable from the middle portion 12, each of which is made out of a separate tubing segment. Details of the preferred snap connection for selectively connecting and disconnecting the three segments of this knock-down configuration will be described in more detail later in connection with FIGS. 8-10. Suffice it to say at this point that the inward end 18 of each hand grip portion 14 is detachably connected to one of the outward ends 30 of the middle portion 12 by means of a retractable locking pin 32 mounted on a leaf spring 34 disposed in the inward end portion 18 of each hand grip 14. The leaf spring 34 is preferably made of spring steel or other flexible material. When the leaf spring 34 is expanded, the locking pin 32—which protrudes through a small opening 36 in the tube wall of the hand grip 14—engages a corresponding aligned opening 38 in the tube wall of the straight end section 30 of the middle portion 12 to lock the hand grip and middle portions together. Depressing the pin 32 compresses the leaf spring 34, causing the pin to disengage from the opening 38 in the middle portion 12 and allow the hand grip portion 14 to be detached from the middle portion.

Figure 7:
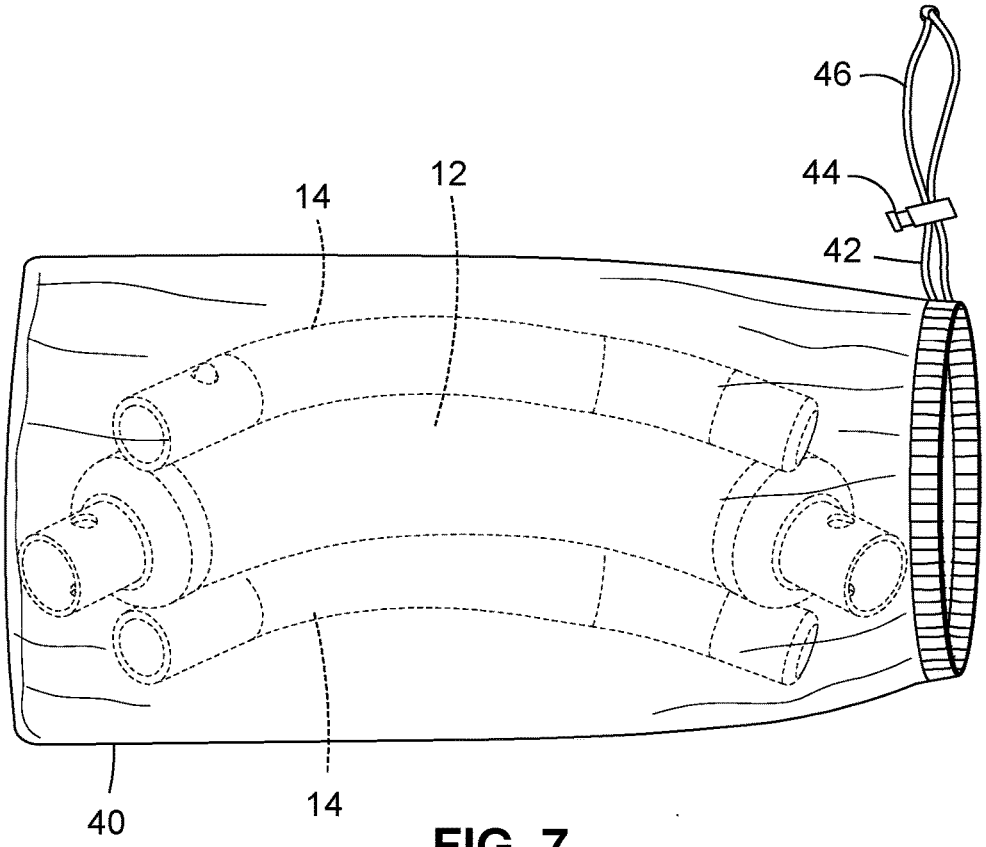
FIG. 7 is an enlarged view of the knocked-down device shown in FIG. 6, with the segments arranged in a storage mode and stored in a carrying pouch.

Referring again to FIG. 6, which shows the device 10 broken down into the middle portion 12 and separate left and right hand grips 14, each of those segments preferably has a length in the range of about 9" to about 11". Due to their compact size and similar shapes, the disassembled pieces can be arranged adjacent each other and placed inside a flexible fabric or leather carrying pouch 40 with a draw string closure 42 as shown in FIG. 7. The draw string 42 can be provided with a movable clip 44 which can be used as a small handle to carry the pouch 40 or to adjust the size of the loop 46 at the end of the drawstring 42 to close the loop around a user's wrist for carrying. In addition to the storage pouch 40 as shown, other types of storage containers also can be used to store the disassembled parts of the exercise device 10. For example, the storage pouch can be configured as a small backpack (not shown) with straps for carrying on the user's back.

Figure 9:
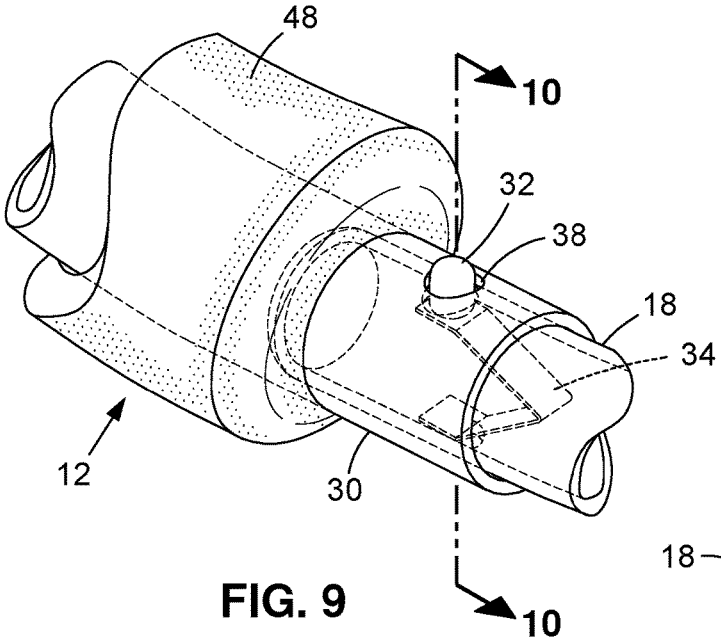
FIG. 9 is an enlarged fragmentary view showing the components of FIG. 8 establishing a telescoping connection between the middle and one of the end portions of the device.
Figure 10:
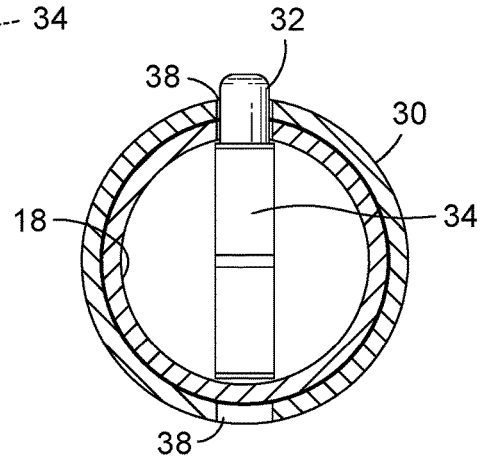
FIG. 10 is a cross-sectional view taken along the lines 9-9 in FIG. 9, showing the tubular construction of the device.
Figure 11:
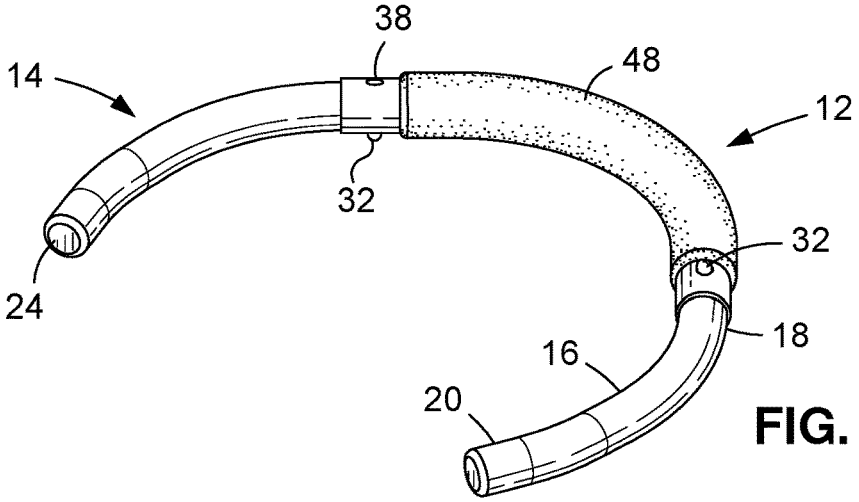
FIG. 11 is a perspective view of the exercise device, as seen from above, showing the hand grips assembled in an alternative configuration.
Figure 12:
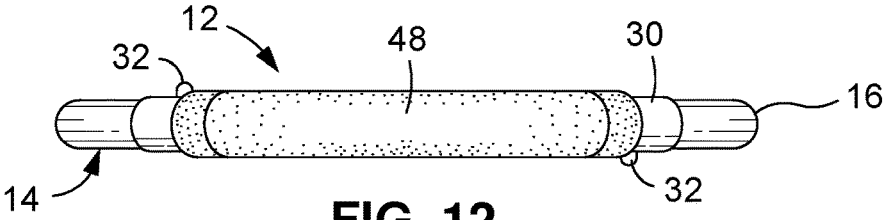
FIG. 12 is a rear view of the device shown in FIG. 11.
Figure 13:
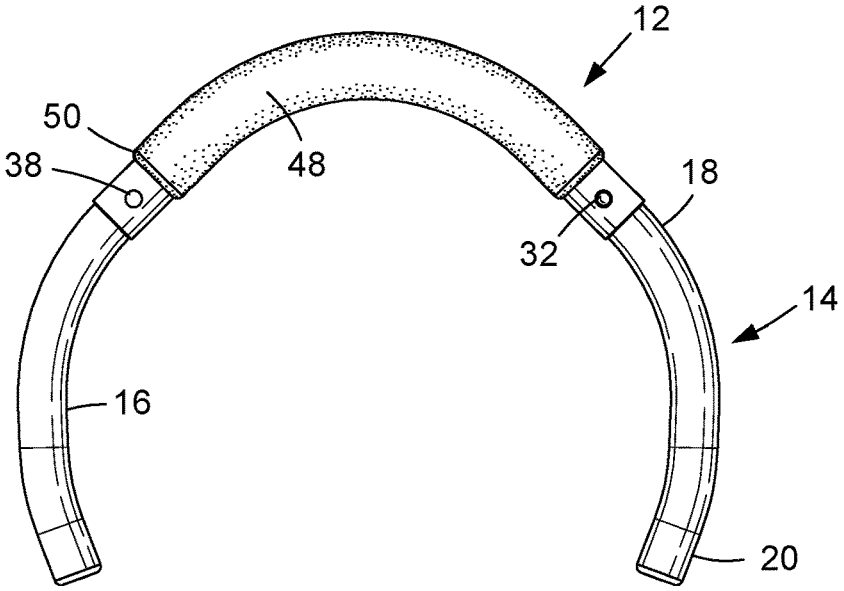
FIG. 13 is a top plan view of the device shown in FIG. 11.
Figure 14:
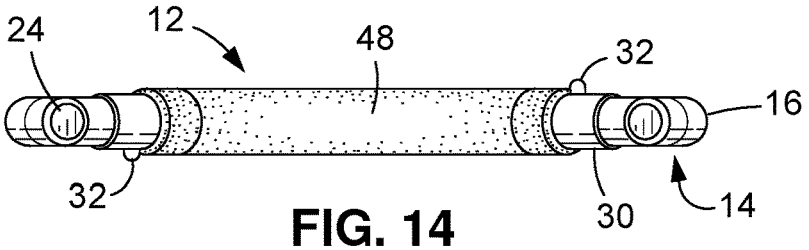
FIG. 14 is a front view of the device shown in FIG. 11.

As seen in more detail in FIGS. 8-10, the inward ends 18 of the hand grips 14 are slidably received in telescoping fashion into the outward ends 30 of the middle portion 12 and locked into place with a retractable locking pin or spring button 32 mounted in the end of the hand grip. The straight construction on the interlocking ends 18, 30 of the hand grips 14 and middle portion 12 facilitate the sliding telescoping movement. In a preferred embodiment, the middle portion 12 has an outside diameter of about 1¼" and an inside diameter of about 1⅛" to slidably receive the ends 18 of the hand grip portions 14 which are about 1 1/16" in outside diameter and about 15/16" in inside diameter. The close clearance between the outside diameter of the hand grip portion 14 and the inside diameter of the middle portion 12 provides a snug fit and limits the amount of play and wiggle between the hand grips and the middle portion when the device is assembled. Additional snugness can be achieved by wrapping the inward end portion 18 of the hand grip 14 with a sleeve (not shown) prior to insertion into the middle portion 12, or by inserting a lining (not shown) into the end 30 of the middle portion 12 before inserting the hand grip portion 14.

Referring again to FIGS. 8-10, the overlapping tube walls in the telescoping sections of the middle and hand grip portions 12, 14 each contain holes 36, 38 which are in a straight radial alignment with each other when the device is fully assembled. In a preferred embodiment, the retractable locking pins 32 which are mounted the inward ends 30 of each hand grip portion 14 are capable of fitting into the holes 36, 38. The pin 32 extends through the hole 36, 38 in the wall of the tubular member and is retracted by virtue of being mounted on a flexible resilient V-shaped clip or leaf spring 34. When the locking pin 32 is depressed, such as by ordinary finger pressure, the clip 34 compresses and the locking pin is pushed down below the hole 36, allowing the tubular member of the hand grip portion 14 to be slidably and telescopically disposed into the end 30 of the middle portion 12. As the sliding movement is continued, the hole 36 in the hand grip portion 14 eventually becomes aligned with the hole 38 in the middle portion 12, whereupon the locking pin 32 pops up into the middle portion hole 38 and locks the tubular members of the middle and hand grip portions 12, 14 together in that position. In a preferred embodiment, the outside diameter of the locking pin 32 is made relatively close to the inside diameter of the locking pin holes 36, 38, to advantageously prevent or limit relative rotation or twisting of the hand grip and middle portions 12, 14 when assembled, thus ensuring that the various portions of the device 10 remain in their intended and proper alignment during use. Depressing the locking pin 32 below the hole 38 in the middle portion 12 allows the hand grip portion 14 to be slidably removed from the end 30 of the middle portion 12. The locking pins 32 are preferably made of metal, but also can be made of other materials such as plastic.

In a presently preferred embodiment, locking pin holes 38 are provided on both the top and the bottom sides of the middle portion 12, radially aligned and spaced 180° degrees apart, as best shown in FIGS. 8-10, and the locking pins 32 are configured to extend through the holes 38 in opposite directions relative to the exercise device 10 when the device is fully assembled, as shown in FIGS. 1-4. Configuring the pins 32 and holes 38 in this manner has at least two advantages. First, it allows the hand grips 14 to be connected to the middle portion 12 in two different ways—the regular configuration shown in FIGS. 1-4 and a reverse or horseshoe configuration as shown in FIGS. 11-14 where the hand grips 14 are rotated on axis by 180° relative to the orientation shown in FIGS. 1-4. In addition, it allows the hand grips 14 to be made identical to each other. No separate left or right grips are required. This reduces manufacturing costs and facilitates case of use and assembly by the end user because it is no longer necessary for the user to keep track of which hand grip 14 fits into which end of the device 10.

Figure 15:
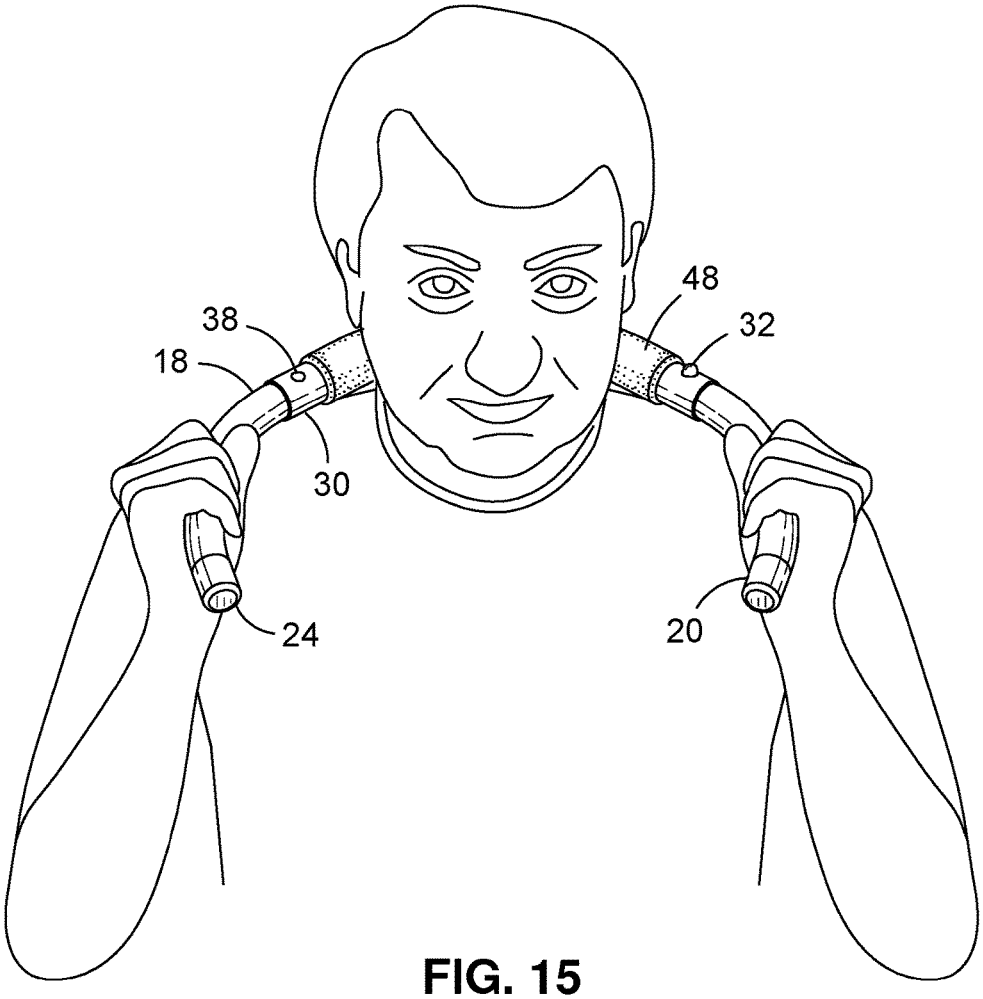
FIG. 15 is a front perspective view of a user utilizing the device shown in FIG. 11.

In the horseshoe configuration as shown in FIGS. 11-15, the hand grips 14 remain co-planar with the middle portion 12 and continue to position the user's hands at shoulder width during use, but the central portion 16 of each hand grip is now configured to be generally perpendicular to the longitudinal axis of the exercise device, such that the palms of the user's hands will face inward toward each other when the central portions are gripped by the user's hands during use, as best shown in FIG. 15. It will be noted that the user's hands remain at generally the same location slightly forward of and above the user's shoulders as when the hand grips 14 are arranged as shown in FIGS. 1-4. Some users may find this horseshoe configuration to be more comfortable to use due to their physical limitations, while retaining many of the same benefits of reduced stress on the shoulders, back and neck muscles provided by the regular configuration shown in FIGS. 1-4.

Referring again to FIGS. 1-4, and to FIGS. 11-14, in a preferred embodiment, the outer surface of the middle portion 12 is sheathed with resilient padding 48, which is disposed around the middle portion of the device 10 for part, but not all, of its length, leaving the locking pin holes 38 exposed. The padding 48 may be made from a variety of different materials, for example, soft rubber or open cell foam for cushioning and absorbency, or closed cell foam which is sturdier and stiffer but still provides good cushioning, shock absorption and is resistant to mold, mildew and bacteria. The padding 48 can be wrapped around the tube in one or more layers. The thickness of the padding 48 can vary from about ⅝" to about 1⅛", or more, as desired. The padding 48 can protect the surface of the tubing and cushion the tube against the user's neck, thus enhancing physical comfort and preventing skin abrasion when the exercise device 10 is in use. Thicker padding generally provides more cushioning and added comfort for the user. Optionally, a similar or different padding material can be wrapped around hand grip portions 14, if desired, to prevent skin abrasions to the user's hands and provide the user with a more comfortable gripping surface.

Figure 16:
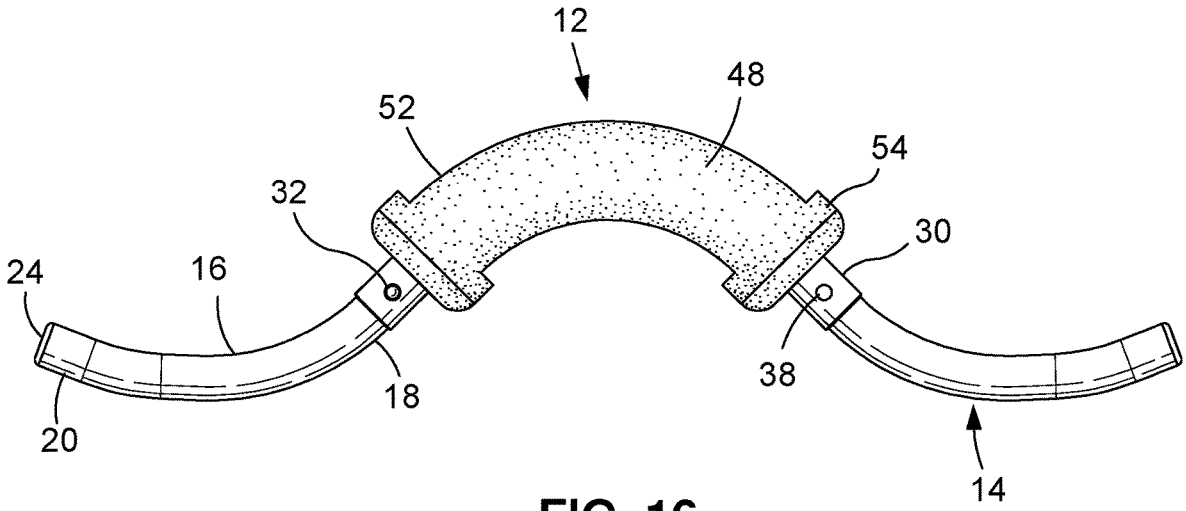
FIG. 16 is a top plan view of the exercise device of FIG. 1, showing thicker padding in the middle portion.

In a preferred embodiment, the padding 48 is provided with beveled ends 50 as shown in FIGS. 1-4, to smooth the transition from padded to unpadded areas of the device 10. For very thick padding, it may be desirable to form a recessed area 52 in the central portion of the padding between enlarged ends 54, as best shown in FIG. 16, to make the padding more form fitting with a cupping effect especially around the back of the user's neck, which may enhance user comfort and resist unwarranted sliding movement of the device 10 across the back of the user's neck.

The padding 48 may be sold as a pre-installed part of the exercise device 10 or as an aftermarket add-on accessory device in the form of a detachable slide-on cylindrical sleeve made of the padding material with a central axial bore sized to closely match the outer diameter of the tubing material.

Figure 17:
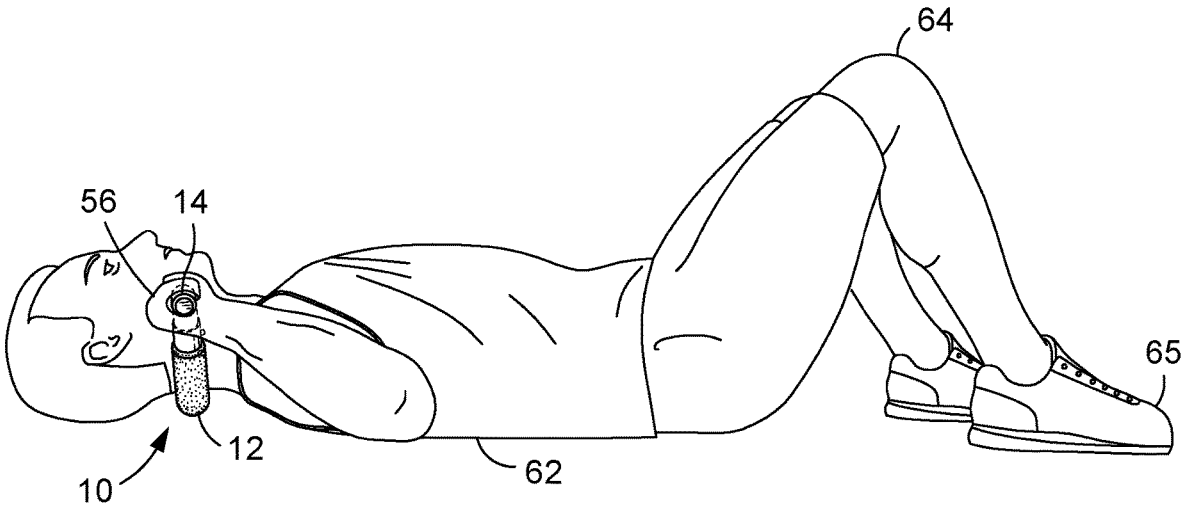
FIG. 17 is a side view showing the starting position of a user utilizing the device of FIG. 1.
Figure 18:
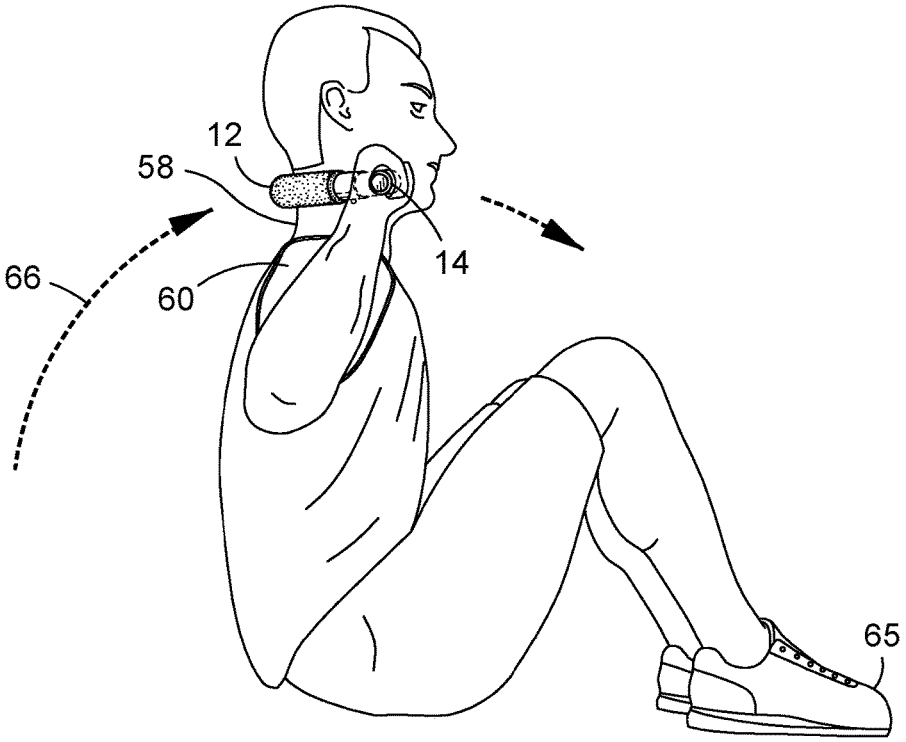
FIG. 18 is a side view showing the active position of a user utilizing the device of FIG. 1.

The exercise device 10 can be used by a person to perform sit-ups while in a supine position by grasping the device with both hands 56—one hand on each hand grip 14 with palms facing forward—and placing the middle portion 12 of the device behind the back of the user's neck 58 resting on the neck above the shoulders 60, as best shown in FIGS. 17-18. Lying on their back 62 with knees 64 bent and feet 65 flat on the floor as shown in FIG. 17, the user then contracts the abdominal muscles to elevate both the upper and lower vertebrae from the floor until everything above the buttocks is not touching the ground and the user is in an upright seated position as shown in FIG. 18. The movement 66 can be made easier by pushing the hands 56 forward against the hand grips 14 while the middle portion 12 is resting on and supporting the back of the user's neck 58. The user can then relax the abdominal muscles to lower his back onto the floor as shown in FIG. 17, while continuing to hold the exercise device against the back of the user's neck 58 throughout the entire range of motion. These movements can be repeated multiple times to exercise the abdominal muscles, in a manner similar to traditional sit-ups.

By maintaining the user's hands 56 at shoulder width and slightly forward and above the user's shoulders 60, the exercise device 10 eliminates strain on the users neck 58 and shoulders 60, and allows the user's shoulders to flex without unduly loading the auxiliary and secondary neck, back and shoulder muscles.

Placing the device 10 behind the user's neck 58 also supports the user's neck and keeps the user's hands, head and neck in the proper position for safely and effectively isolating and targeting the abdominal muscles for exercise. It also helps to relieve high compressive lumbar loads and lower back strain when performing sit-ups or other exercise that involve elevating both the upper and lower back from the floor and bending at the waist from a supine toward a seated position in order to strengthen, tighten and tone abdominal muscles. The forward force of the user's arms against the device 10 can assist in raising the user's neck 58 and back 62 from the floor without flexing the neck forward or rounding the upper back each time the user elevates the back from the floor.

In addition to performing these sit-up type of exercises, the exercise device 10 also can be used to perform a variety of additional exercises from a supine or seated position, thus maximizing the utility of the device as an exercise apparatus. Examples of exercises that can be performed with the device 10 from a supine position include sit-ups (regular), sit-ups (twists), bicycle crunches and elevated leg crunches. Examples of exercises that can be performed with the device 10 from a seated position include Russian twists and the static boat pose, as well as leg raises and reverse crunches performed in a Fowler's position. All of these exercises are performed while holding the exercise device 10 with the hands 56 on the hand grips 14 and the middle portion 12 resting on the back of the user's neck 58 above the user's shoulders 60, as previously described.

Figure 19:
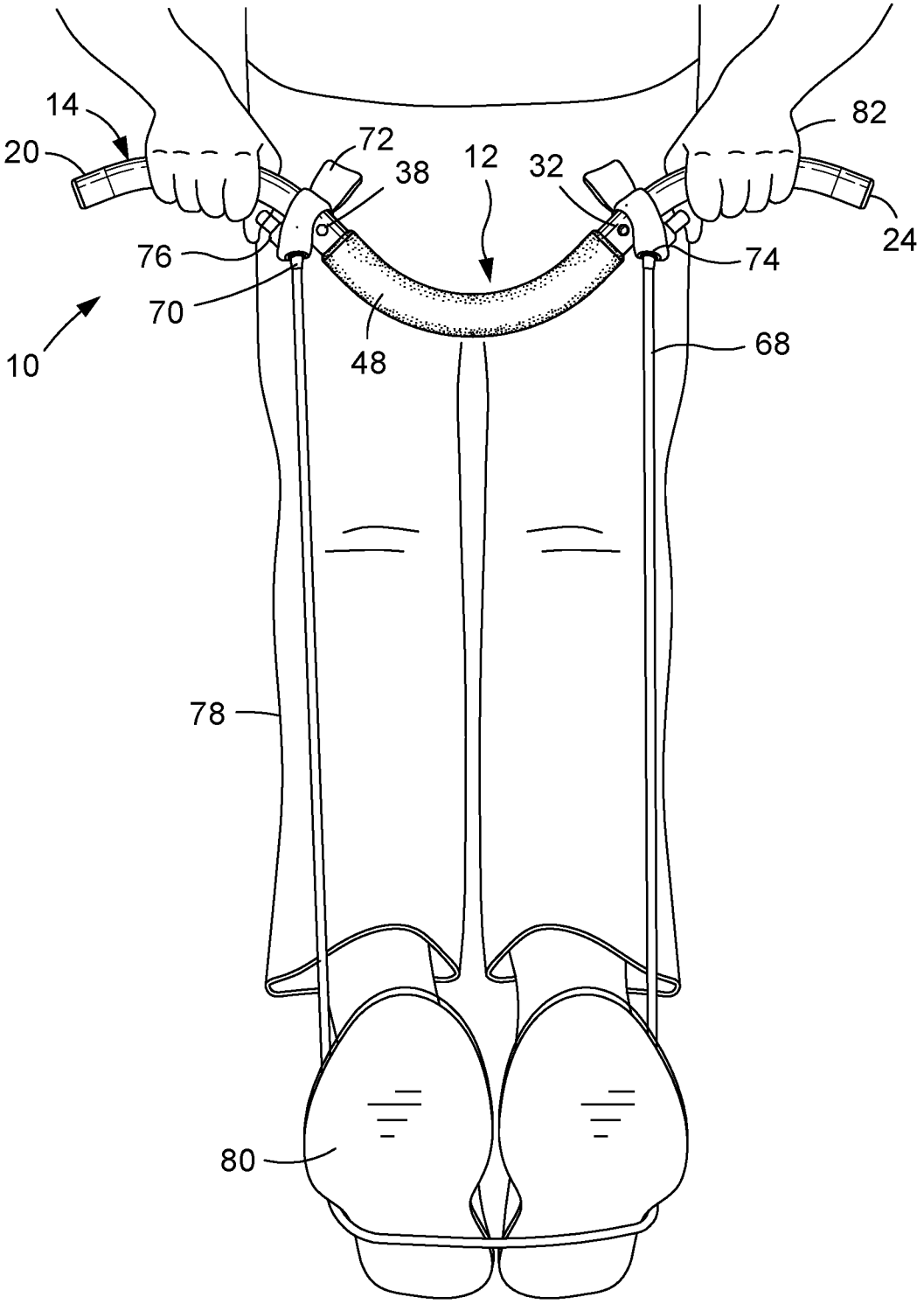
FIG. 19 is a top perspective view of a user utilizing the device shown in FIG. 1 for a rowing type exercise.

The device 10 also can be used to perform rowing type exercises with the aid of an elastic resistance band 68 as shown in FIG. 19. The ends 70 of the resistance band 68 are removably attached to the exercise device 10 near the junction between the hand grip and middle portions 14, 12 with straps 72 made of strong woven nylon webbing that are connected to the ends of the resistance band. The straps 72 are preferably connected to the resistance band 68 in a permanent manner which can be done in various ways, including for example, by passing the ends 70 of the resistance band 68 through grommet holes 74 on the straps 72 and terminating the ends of the band with enlarged heads 76 that are too large in diameter to pass through grommet hole.

While in a seated position with legs 78 outstretched, the user then places the resistance band 68 over the bottom of his feet 80 and grasps the hand grips 14 in each hand 82 with palms facing downward, as shown in FIG. 19. The user pulls the exercise device 10 toward his chest against the contracting force of the resistance band 68, then relaxes to allow the resistance band to return the exercise device to its original position away from the user's chest and closer to the user's feet 80, repeating this motion as many times as desired to simulate a rowing action.

From the forgoing, it will be appreciated that the exercise device 10 of the present invention reduces the stress and strain on a user's neck, shoulders and back by keeping the user's hands, head and neck in proper exercise position when performing sit-ups and other abdominal exercises in a supine or seated position. Further, the hand grips 14 can be reconfigured allowing the user to choose between two different hand positions and select the one most comfortable for use, and the device 10 can be disassembled and reduced in size for compact storage and transport by removing the hand grips 14 and placing them alongside the middle portion 12 inside a storage pouch 40 or other container. The device 10 is also extremely easy to manufacture and use, and can be used to perform a variety of different exercises.

While several particular forms of the invention have been illustrated and described, it will be apparent that various modifications can be made without departing from the spirit and scope of the invention as set forth in the appended claims. Accordingly, it is not intended that this invention be limited, except as by the appended claims.

I claim:

1. A hand-held exercise device for use in performing exercises from a supine or seated position, comprising:

a substantially rigid assembly which includes left and right side hand grip portions held laterally spaced apart by a transverse middle portion which is continuous and coplanar with the hand grip portions;

the middle portion being configured to fit around a back portion of a user's neck and to extend between the back portion of the user's neck and a front of the user's shoulders;

the left side hand grip portion extending away from the middle portion and being configured to hold a user's left hand slightly forward of and above the user's left shoulder when gripped by the user's left hand;

the right side hand grip portion extending away from the middle portion and being configured to hold a user's right hand slightly forward of and above the user's right shoulder when gripped by the user's right hand;

the hand grip portions being spaced apart by a distance corresponding to the user's shoulder width so that the user's hands are held at shoulder width when grasping the hand grip portions during use; and wherein the hand grip portions are adjustable between a first operative configuration where the hand grip portions are selectively secured to the middle portion with the hand grip portions extending generally parallel to a longitudinal axis of the exercise device to hold the user's hands with palms facing forward when grasping the hand grip portions during use, and a second operative configuration where the hand grip portions are selectively secured to the middle portion with the hand grip portions extending generally perpendicular to the longitudinal axis of the exercise device to hold the user's hands with palms facing inward toward each other when grasping the hand grip portions during use.

2. The exercise device of claim 1, wherein the left and right side hand grip portions extend away from the middle portion in opposite directions are coaxially aligned along a common longitudinal axis when the hand grip portions are in the first operative configuration.

3. The exercise device of claim 1, wherein the left and right side hand grip portions extend away from the middle portion in a forward direction generally parallel to each other to hold the user's hands with palms facing inward toward each other when the hand grip portions are in the second operative configuration.

4. The exercise device of claim 1, wherein each of the hand grip portions is selectively detachable from the middle portion for storage and transport, and selectively attachable to the middle portion in the first or second operative configuration for use.

5. The exercise device of claim 4, wherein the hand grip portions are identical to each other when detached from the middle portion.

6. A hand-held exercise device for use in performing exercises from a supine or seated position, comprising:

a substantially rigid assembly which includes left and right side hand grip portions held laterally spaced apart by a transverse middle portion which is continuous and coplanar with the hand grip portions;

the middle portion being configured to fit around a back portion of a user's neck and to extend between the back portion of the user's neck and a front of the user's shoulders;

the left side hand grip portion extending away from the middle portion and being configured to hold a user's left hand slightly forward of and above the user's left shoulder when gripped by the user's left hand;

the right side hand grip portion extending away from the middle portion and being configured to hold a user's right hand slightly forward of and above the user's right shoulder when gripped by the user's right hand;

the hand grip portions being spaced apart by a distance corresponding to the user's shoulder width so that the user's hands are held at shoulder width when grasping the hand grip portions during use;

wherein the exercise device is comprised of three detachable tubular segments, one segment corresponding to the middle portion and two segments corresponding to each of the hand grip portions, respectively.

7. The exercise device of claim 6, wherein each hand grip portion has an inward end configured to be slidably received in a telescoping manner into an outward end of the middle portion.

8. The exercise device of claim 6, further comprising retractable locking pins for locking the tubular segments in place relative to one another.

9. The exercise device of claim 8, wherein each of the tubular segments has a hole extending radially through a wall of the tubular segment, and the retractable locking pins are arranged for engaging with said holes such that when the locking pins are inserted into the holes in both the middle and hand grip portions, the tubular segments corresponding to the middle and hand grip portions are locked in place relative to one another.

10. The exercise device of claim 8, wherein the tubular segments corresponding to the hand grip portions are selectively detachable from the middle portion by depressing the retractable lock pins and disengaging the tubular segments from each other.

11. The exercise device of claim 6, wherein each of the detachable tubular segments has an arcuate shape and substantially equal length in the range of about 9" to about 11" as measured along a straight line joining opposite ends of the segment.

12. A hand-held exercise device for use in performing exercises from a supine or seated position, comprising:

a substantially rigid assembly of predetermined length which includes left and right side hand grip portions held laterally spaced apart by a transverse middle portion which is continuous and coplanar with the hand grip portions;

the middle portion being configured to fit around a back portion of a user's neck and to extend between the back portion of the user's neck and a front of the user's shoulders;

the left side hand grip portion extending away from the middle portion and being configured to hold a user's left hand slightly forward of and above the user's left shoulder behind the user's face when gripped by the user's left hand;

the right side hand grip portion extending away from the middle portion in a direction opposite to the left side hand grip portion and being configured to hold a user's right hand slightly forward of and above the user's right shoulder behind the user's face when gripped by the user's right hand;

the left and right side hand grip portions being coaxially aligned along a common longitudinal axis and spaced apart sufficiently to hold the user's hands at shoulder width when grasping the hand grip portions during use;

wherein each of the hand grip portions has an outermost end, and the exercise device has a length of less than about 30" as measured along a straight line joining the outermost ends, and a width of about 5" to about 6" as measured along a straight line taken at right angles to the length.

13. The exercise device of claim 12, wherein the exercise device is made of light weight tubular material selected from the group consisting of aluminum and plastic.

14. The exercise device of claim 12, further comprising a cylindrical sleeve of padding material disposed around a mid-section of the middle portion.

15. The exercise device of claim 14, wherein the sleeve has a reduced diameter central portion disposed between two enlarged diameter end portions.

16. The exercise device of claim 14, wherein the sleeve has beveled ends to smooth the transition from the padding material to adjacent areas of the middle portion.

17. A method for using the exercise device of claim 12 to exercise abdominal muscles from a supine position, comprising:

placing the exercise device of claim 1 behind a user's neck when the user is in a supine position;

grasping the hand grip portions of the exercise device with both hands such that the user's hands are positioned at shoulder width in a laterally spaced position slightly forward and above the person's shoulders;

holding the middle portion of the exercise device against the back of the user's neck above the user's shoulders;

contracting the abdominal muscles to elevate the user's back toward the user's knees while gripping the exercise device and holding it against the back of the user's neck above the user's shoulders;

relaxing the abdominal muscles to lower the user's back while gripping the exercise device and holding it against the back of the user's neck above the user's shoulders; and repeating said contracting and relaxing steps multiple times to exercise the abdominal muscles.

18. A method for using the exercise device of claim 12 to exercise abdominal muscles from a supine or seated position, comprising:

placing the exercise device of claim 1 behind a user's neck when the user is in position;

grasping the hand grip portions of the exercise device with both hands such that the user's hands are positioned at shoulder width in a laterally spaced position slightly forward and above the user's shoulders;

holding the middle portion of the exercise device against the back of the user's neck above the user's shoulders; and performing an exercise selected from the group consisting of sit-ups, bicycle crunches, elevated leg crunches, Russian twists, the static boat pose, leg raises and reverse crunches while grasping the hand grip portions and holding the middle portion against the back of the user's neck above the user's shoulders.

19. A method of using the exercise device of claim 12 to perform an exercise while in a seated position with legs outstretched in front of a user's body, comprising:

connecting a resistance band to the exercise device;

placing a central portion of the resistance band under the user's feet;

placing the exercise device in front of the user's body;

grasping the hand grip portions of the exercise device with both hands with palms facing downward;

pulling the exercise device horizontally toward the user's chest against a contracting force of the resistance band;

relaxing to allow the resistance band to return the exercise device to a position closer to the user's feet; and repeating the pulling and relaxing steps multiple times to exercise the user's muscles.

20. The exercise device of claim 12, wherein each of the hand grip portions has a central portion bounded at each end by angled end portions which confine the user's hands to the central portion of the hand grip portion.

* * * * *